US007775746B2

(12) United States Patent
Kim et al.

(10) Patent No.: US 7,775,746 B2
(45) Date of Patent: Aug. 17, 2010

(54) PHC PILE USED IN PERMANENT RETAINING WALL STRUCTURE AND CONNECTION METHOD OF PHC PILE

(75) Inventors: Kwang-Man Kim, Seoul (KR); Sang-Mun Yun, Seoul (KR)

(73) Assignee: Baro Construction Key-Technology Co., Ltd. (KR)

( * ) Notice: Subject to any disclaimer, the term of this patent is extended or adjusted under 35 U.S.C. 154(b) by 572 days.

(21) Appl. No.: 10/597,729

(22) PCT Filed: Feb. 4, 2005

(86) PCT No.: PCT/KR2005/000332

§ 371 (c)(1),
(2), (4) Date: Oct. 22, 2007

(87) PCT Pub. No.: WO2005/075748

PCT Pub. Date: Aug. 18, 2005

(65) Prior Publication Data

US 2009/0155001 A1 Jun. 18, 2009

(30) Foreign Application Priority Data

Feb. 5, 2004 (KR) ..... 10-2004-0007691

(51) Int. Cl.
*E02D 5/02* (2006.01)

(52) U.S. Cl. ..... 405/286; 405/284; 405/285; 405/232; 405/231; 405/279

(58) Field of Classification Search ..... 405/231, 405/286, 284, 285, 232, 281, 279, 275
See application file for complete search history.

(56) References Cited

U.S. PATENT DOCUMENTS 942,142 A * 12/1909 Holmes ..... 405/275
5,320,453 A * 6/1994 Bullivant ..... 405/239

FOREIGN PATENT DOCUMENTS

JP 04306324 * 10/1992
JP 6240660 * 8/1994

OTHER PUBLICATIONS http://www.merriam-webster.com/dictionary/pipe.*

* cited by examiner

*Primary Examiner*—David J Bagnell
*Assistant Examiner*—Sean D Andrish
(74) *Attorney, Agent, or Firm*—Fish & Richardson P.C.

(57) ABSTRACT

The present invention relates to a PHC pile used in a permanent retaining wall structure, and a connection method thereof, and more particularly, to a method of connecting PHC piles to each other by inserting a connection bar into connection pipes embedded in sheaths of the PHC piles. To this end, the PHC pile comprises a left connection pipe installed at one side of the sheath of the PHC pile and a right connection pipe embedded at the other opposite side of the sheath. Further, the method of connecting the PHC pile to each other comprises the steps of inserting a water-proof material into inner semi-cylindrical grooves of the connection pipes, inserting the connection bar between the connection pipes of the PHC piles, and consecutively connecting a plurality of PHC piles to one another by repeating the above steps.

5 Claims, 7 Drawing Sheets

[Fig. 1]
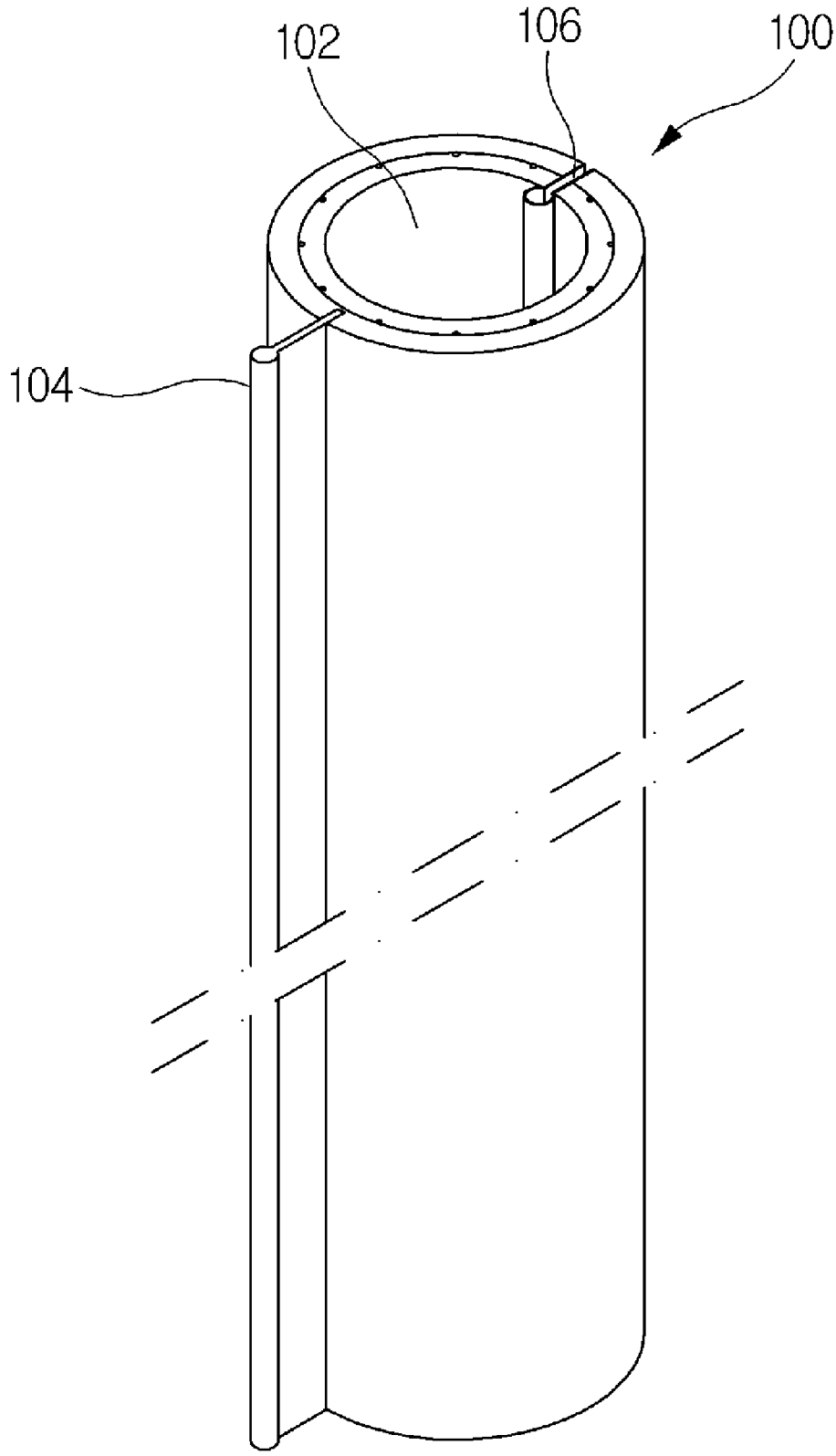

[Fig. 2]
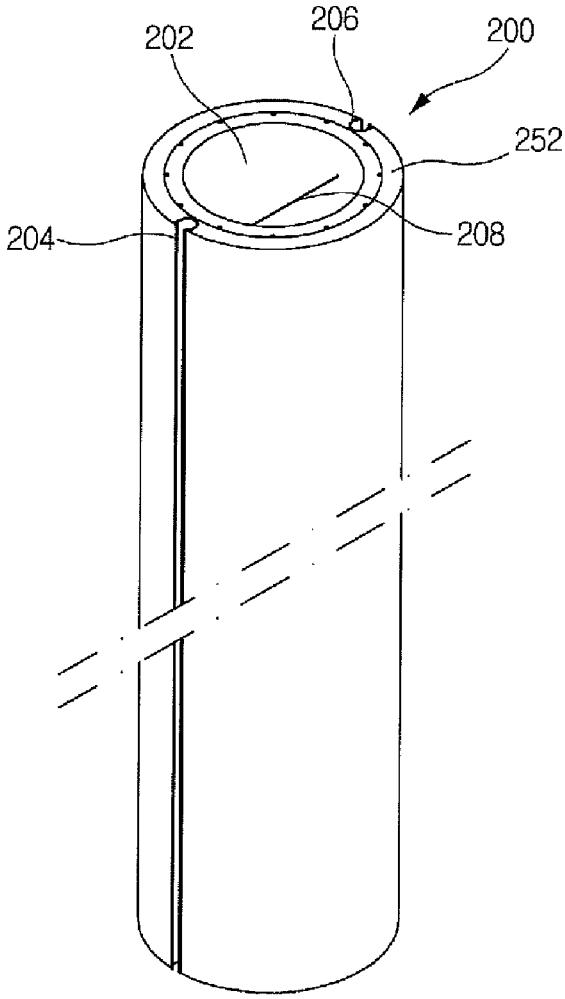
[Fig. 3]
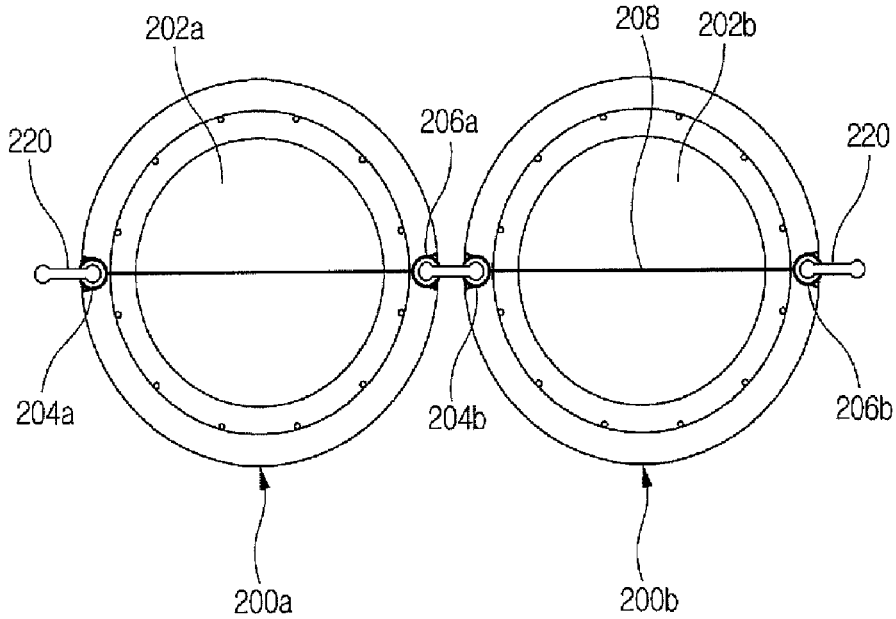

[Fig. 4]
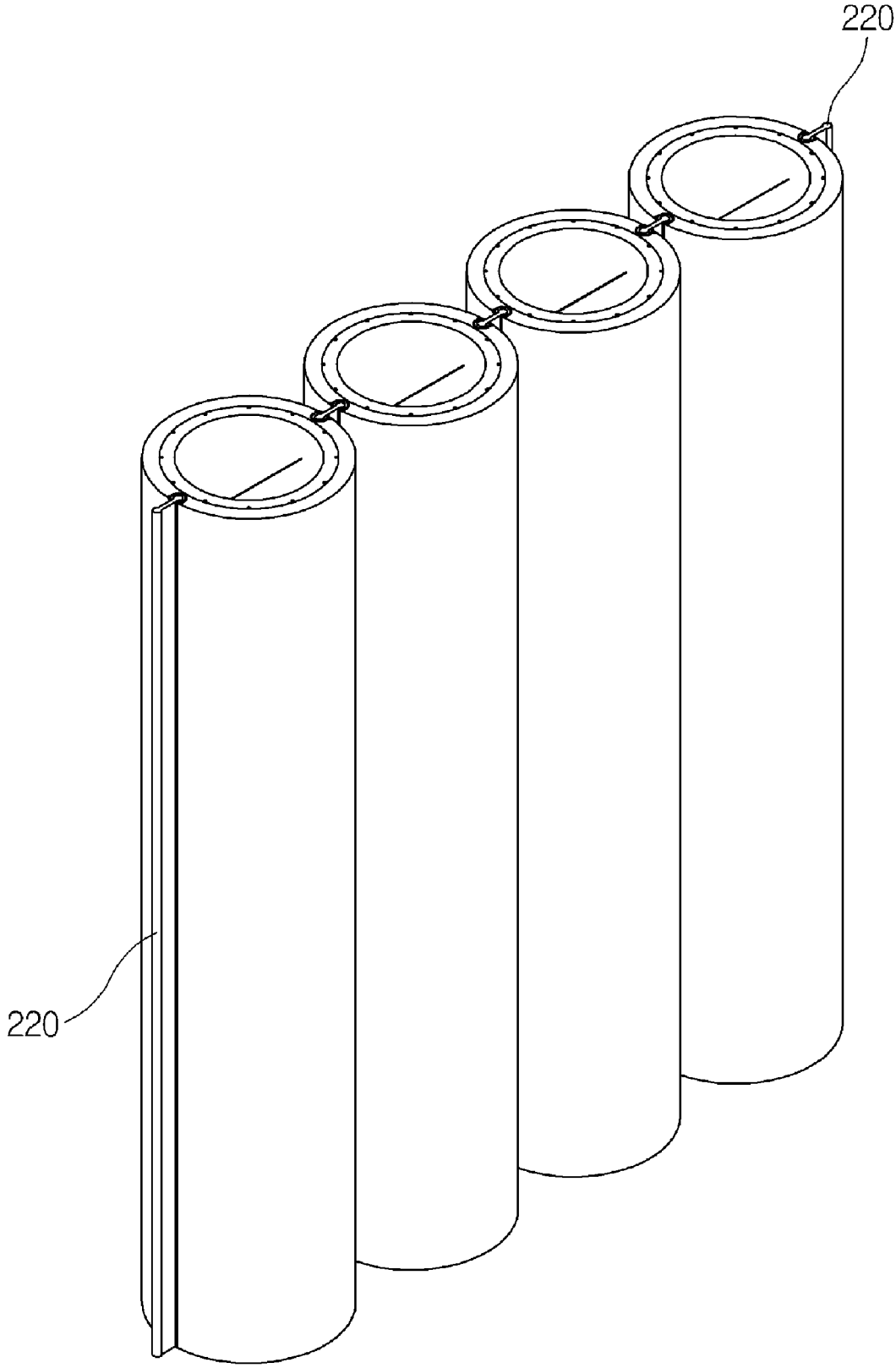

[Fig. 5]
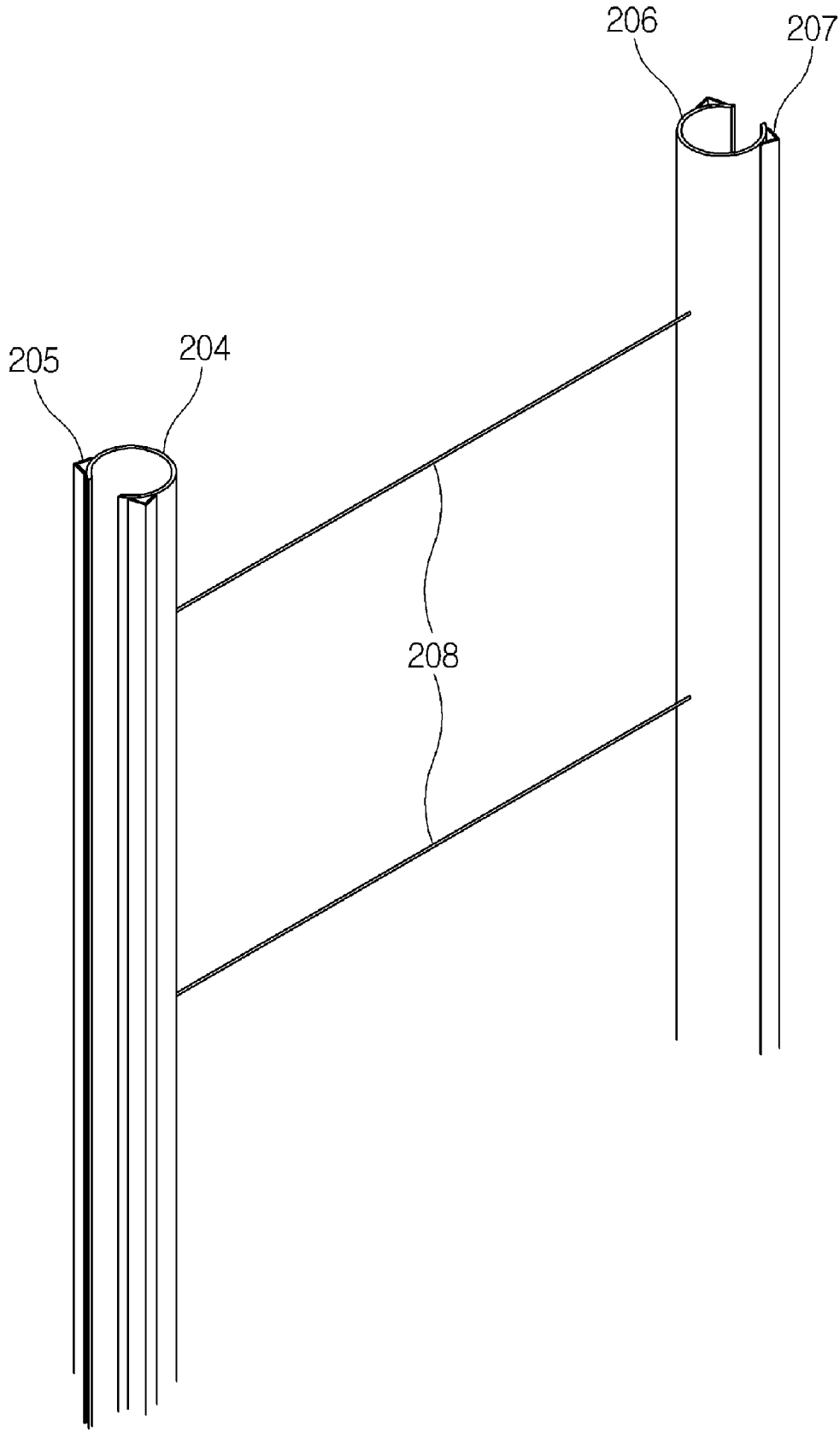

[Fig. 6]
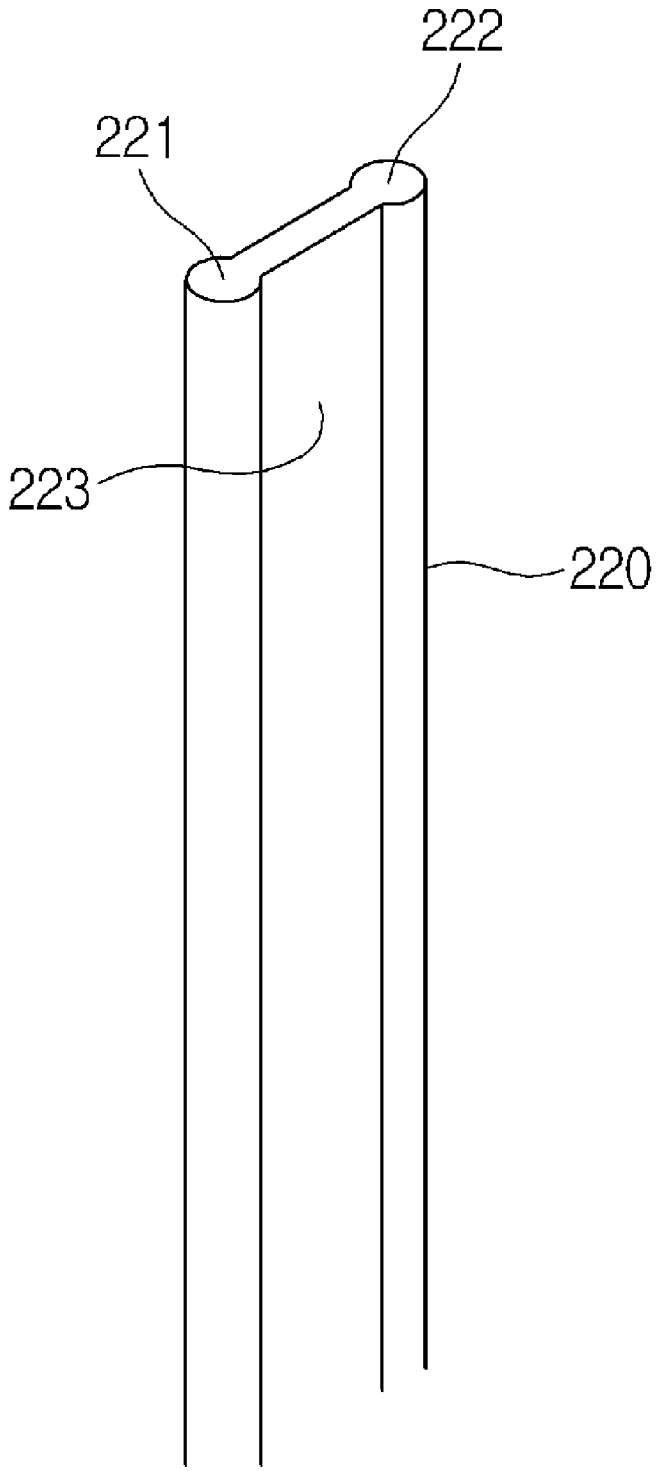

[Fig. 7]
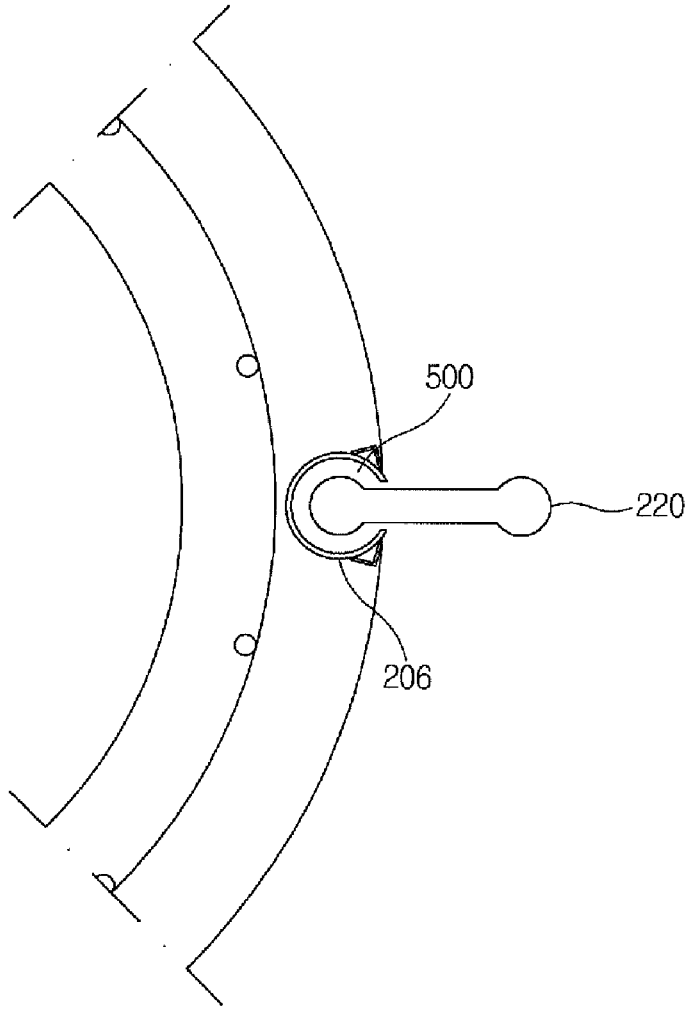
[Fig. 8]
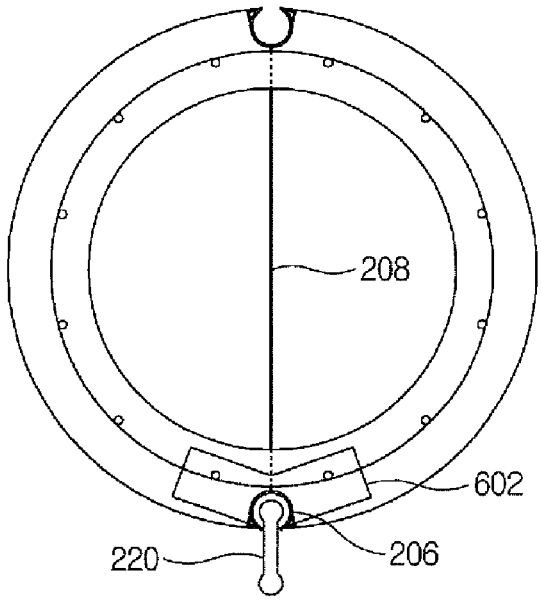

[Fig. 9]
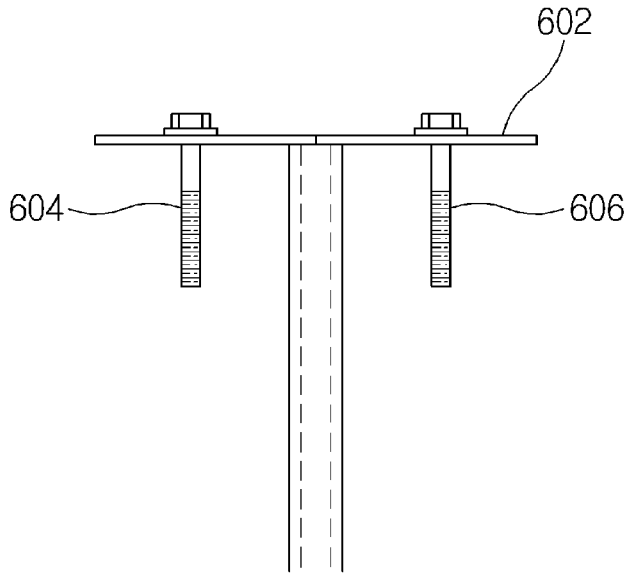
[Fig. 10]
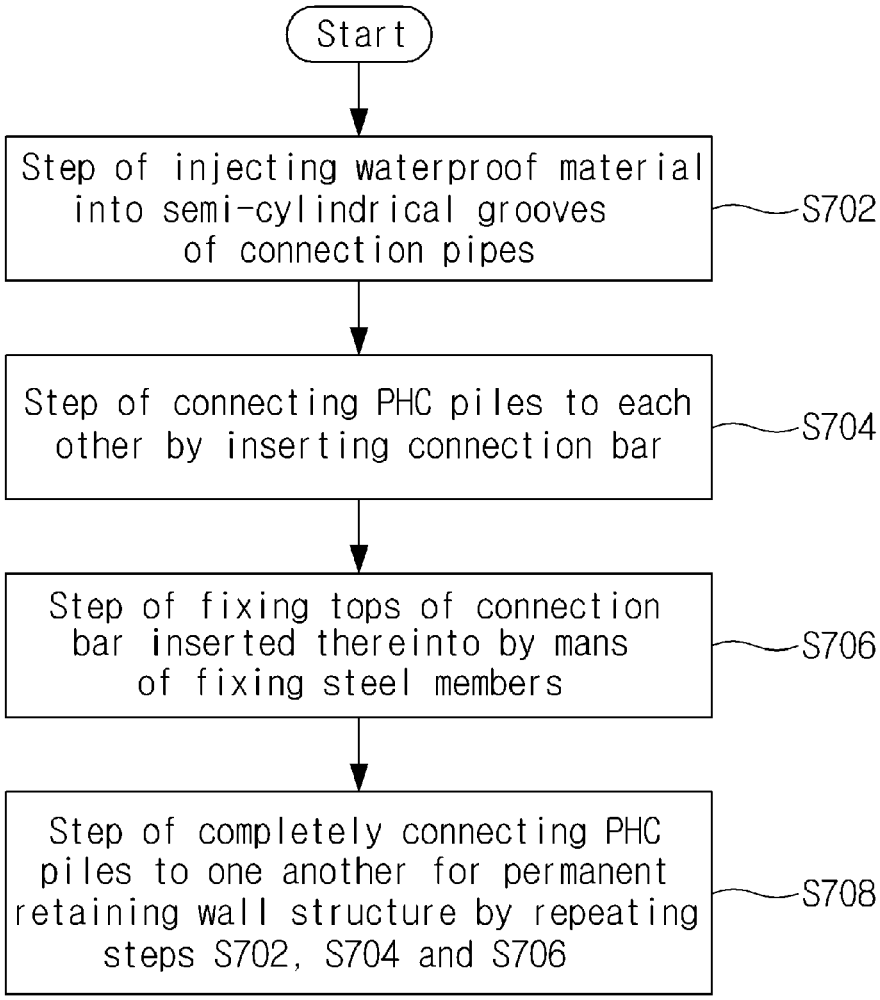

PHC PILE USED IN PERMANENT RETAINING WALL STRUCTURE AND CONNECTION METHOD OF PHC PILE

TECHNICAL FIELD

The present invention relates to a PHC pile used in a permanent retaining wall structure and a connection method thereof, wherein connection pipes are embedded in a PHC pile and connection bars are inserted into the connection pipes.

BACKGROUND ART

Generally, methods of constructing retaining wall structures include a slurry wall method, a soil cement wall (SCW) method, a concrete in-situ pile (CIP) method, a sheet pile method, and the like. Among the aforementioned methods, other methods except the slurry wall method are methods of constructing temporary retaining wall structures that not only become obstacles when a variety of construction materials are moved or unloaded, concrete is poured, or a building lot is dug, but also should be installed, dismantled or moved through processes separate from main construction works, thereby increasing construction costs and prolonging a construction period.

In this regard, there has been recently used the slurry wall method, which is a method of constructing a permanent retaining wall that will be utilized as foundations and an outer wall structure of a construction. However, the slurry wall method of constructing a permanent retaining wall has problems in that a lot of construction equipment is required and construction costs increase in constructing the retaining wall. To solve these problems, the applicant filed a Korean utility model application (corresponding to Korean Utility Model Registration No. 20-0313739) entitled "Retaining wall structure using PHC pile", which discloses a novel method of constructing a permanent retaining wall structure, wherein construction costs are reduced and construction processes are simplified.

The method of constructing a permanent retaining wall structure disclosed in the Utility Model Registration entitled "Retaining wall structure using PHC pile" is characterized in that a PHC pile 100 comprises a hollow 102 formed at the center thereof, and a female steel connector 106 and a male steel connector 104 embedded at opposite sides of a periphery thereof, so that a plurality of PHC piles can be connected to one another by means of the female and male steel connectors 106 and 104, as shown in FIG. 1.

In the method of constructing a permanent retaining wall structure using the PHC pile, however, there is inconvenience in that the female and male steel connectors 106 and 104 should be connected by means of iron reinforcing rods upon construction of a retaining wall structure by interconnecting PHC piles to one another. This cannot meet the intention of manufacture of a PHC pile that should be mass-produced in a factory. Further, since the male steel connector 104 of the PHC pile 100 is made to protrude, there are problems in that the protruding portion of the male steel connector may be very likely to be damaged during curing or movement of the PHC pile, whereby the male steel connector may not be suitable for connection of retaining walls which requires accurate dimensions thereof.

DISCLOSURE OF INVENTION

Technical Problem

The present invention is conceived to solve the aforementioned problems. An object of the present invention is to provide a method of connecting PHC piles to each other without a male steel connector used in a conventional PHC pile. Further, another object of the present invention is to provide a PHC pile structure required for such connection.

Technical Solution

To achieve the objects, a PHC pile used in a permanent retaining wall structure according to the present invention comprises a left connection pipe installed at one side of a sheath of the PHC pile and a right connection pipe embedded at the other side of the sheath opposite thereto so that connection bars for connecting a plurality of PHC piles to one another can be inserted into the connection pipes.

Further, a method of connecting PHC piles to each other comprises the steps of inserting a waterproof material into an inner semi-cylindrical groove of a right connection pipe of a first PHC pile and an inner semi-cylindrical groove of a left connection pipe of a second PHC pile, inserting a connection bar for connecting the PHC piles between the right connection pipe of the first PHC pile and the left connection pipe of the second PHC pile, attaching a fixing steel member to an upper end of the right connection pipe of the first PHC pile and an upper end of the left connection pipe of the second PHC pile into which the connection bar has been inserted so as to prevent the connection bar from coming out, and consecutively connecting a plurality of PHC piles to one another by repeating the aforementioned three steps.

Accordingly, the PHC pile of the present invention has a structure in which connection parts can be separated from each other upon curing or movement of the PHC pile, so that the connection media of the PHC pile cannot be damaged. That is, the connection pipe serving as a female connection body is embedded in and produced integrally with the PHC pile upon production of the PHC pile, while the connection bar serving as a male connection member is assembled directly upon driving of the PHC pile, thereby minimizing damage to the connection media of the PHC pile.

BRIEF DESCRIPTION OF THE DRAWINGS

FIG. 1 is a perspective view of a conventional PHC pile.

FIGS. 2 to 4 are views of a PHC pile according to the present invention, wherein FIGS. 2 and 4 are perspective views thereof and FIG. 3 is a sectional view thereof.

FIG. 5 is a perspective view of connection tubes.

FIG. 6 is a perspective view of a connection bar.

FIG. 7 is a diagram illustrating a state where the connection bar is inserted into the connection pipe.

FIGS. 8 and 9 are a plan view and a sectional view showing a state where a fixing steel member is attached to the PHC pile.

FIG. 10 is a flowchart illustrating the steps of connecting PHC piles according to the present invention.

BEST MODE FOR CARRYING OUT THE INVENTION

Hereinafter, a most preferred embodiment of the present invention will be described in detail with reference to the accompanying drawings.

FIG. 2 is a perspective view showing a PHC pile according to the present invention, FIG. 3 is a sectional view showing a state where PHC piles are connected to each other, and FIG. 4 is a perspective view showing a permanent retaining wall structure formed by connecting the PHC piles to one another.

As shown in FIG. 2, the PHC pile 200 according to the present invention comprises a hollow 202 at the center thereof defined by a two-ply cylindrical sheath 252, and a left connection pipe 204 and a right connection pipe 206 embedded at opposite sides of the sheath 252 of the PHC pile.

After the PHC pile 200 has been driven into the ground, concrete is poured into the hollow 202 to improve the bending strength of the PHC pile and to allow the PHC pile to resist against much larger load at the top thereof. This also allows the PHC pile 200 to be securely fixed without hanging in the air in a case where the PHC pile 200 is installed using an anchor required for connecting the PHC pile to a construction.

The left and right connection pipes 204 and 206 embedded in the PHC pile 200 are insertion pipes for use in connecting the PHC pile to other next PHC piles and take the shape of a cylindrical pipe with a cut-away portion. Lateral sides of the cut-away portions of the left and right connection pipes 204 and 206 are reinforced by thick, connection pipe-reinforcing members 205 and 207 to improve durability of the left and right connection pipes 204 and 206.

Further, the left and right connection pipes 204 and 206 are embedded in the sheath 252 of the PHC pile so that they do not interfere with manufacturing processes of the PHC pile upon mass production thereof in a factory.

Meanwhile, if the left and right connection pipes 204 and 206 are embedded in the sheath of the PHC pile, they may inadvertently come out from the PHC pile even though small impact is applied thereto. To prevent this, elongated binding steel members 208 are inserted between the left and right connection pipes 204 and 206, thereby preventing the left and right connection pipes 204 and 206 from coming out. The elongated binding steel members 208 are provided at a predetermined interval to closely connect the left and right connection pipes 204 and 206 to each other.

Meanwhile, a plurality of PHC piles are serially connected to one another by means of connection bars 220 to form a retaining wall structure, as shown in FIG. 3. Each of the connection bars 220 is inserted into a right connection pipe 206*a* of a first PHC pile 200*a* and a left connection pipe 204*b* of a second PHC pile 200*b*. Thus, the plurality of PHC piles can be connected to one another in such a manner.

To connect the plurality of PHC piles to one another as described above, the connection bar 220 is configured such that it can be inserted into semi-cylindrical grooves of the right connection pipe 206*a* of the first PHC pile and the left connection pipe 204*b* of the second PHC pile. For example, if the right connection pipe 206*a* of the first PHC pile and the left connection pipe 204*b* of the second PHC pile are in the form of a semi-cylindrical female body with a cut-away portion, the connection bar 220 should be in the form of a semi-cylindrical male body that can be caught in the semi-cylindrical female body.

Therefore, when the plurality of PHC piles are connected to one another by means of the connection bars 220, the right connection pipe 206*a* of the first PHC pile and the left connection pipe 204*b* of the second PHC pile serve as female connection bodies and the connection bars 220 serve as male connection bodies.

FIG. 6 shows a perspective view of an external appearance of the connection bar 220, wherein both lateral ends of the connection bar are in the form of a blunt semi-cylindrical male body that can be inserted into the left and right connection pipes 204 and 206 of the PHC pile 200 and a central body portion 223 of the connection bar takes the shape of a plate. Further, the connection bar 220 has the same height as the PHC pile as shown in FIG. 4.

Meanwhile, as for construction work for inserting the connection bar 220 into the left and right connection pipes 204 and 206 to connection the plurality of PHC piles to one another, a waterproof material is inserted into an inner groove 500 of the left or right connection pipe 204 or 206 so that the waterproof material in the inner groove 500 of the connection pipe is pushed out upon insertion of the connection bar 220 into the left or right connection pipe 204 or 206, whereby the waterproof material surround the periphery of the left or right connection pipe 204 or 206 with the connection bar 220 inserted thereinto, as shown in FIG. 7. Thus, waterproof performance is secured.

Meanwhile, after the construction work for inserting the connection bar 220 into the right connection pipe 206 (or left connection pipe) to connection the plurality of PHC piles to one another, a fixing steel member is attached to the top of the right connection pipe 206 (or left connection pipe) with the connection rod inserted thereinto, thereby preventing the connection bar from coming out. For example, referring to FIG. 8 in which the PHC pile is viewed from thereabove, it can be seen that the fixing steel member 602 is attached to the top of the right connection pipe 206 (or left connection pipe) with the connection bar 220 inserted thereinto.

FIG. 9 shows a sectional view of the fixing steel member. The fixing steel member is attached to the connection pipe of the PHC pile by means of bolts 604 and 606.

FIG. 10 is a flowchart illustrating the process of constructing a permanent retaining wall structure using the PHC piles according to the present invention. Now, the flowchart will be described while referring again to FIG. 3 that is the sectional view showing the connection of the PHC piles.

To install the permanent retaining wall structure using the PHC piles, the waterproof material is first inserted into the inner semi-cylindrical grooves of the right connection pipe 206*a* (hereinafter, referred to as "first right connection pipe) embedded in the first PHC pile 200*a* and the left connection pipe 204*b* (hereinafter, referred to as "second left connection pipe) embedded in the second PHC pile 200*b* (step S702). Thus, after the waterproof material has been inserted, the inner semi-cylindrical grooves of the first right connection pipe 206*a* and the second left connection pipe 204*b* are filled with the waterproof material.

Accordingly, since the waterproof materials in the inner semi-cylindrical grooves of the connection pipes will be pushed out upon insertion of the connection bar 220 into the first right connection pipe 206*a* and the second left connection pipe 204*b*, peripheral portions around the connection pipes will be waterproofed.

After the insertion of the waterproof material, the connection bar 220 is inserted into the first right connection pipe 206*a* and the second left connection pipe 204*b* to connect the first PHC pile 200*a* to the second PHC pile 200*b* (step S704). That is, one lateral end of the connection bar 220 is inserted into the first right connection pipe 206*a* of the first PHC pile 200*a*, and the other lateral end of the connection bar 220 is inserted into the second left connection tube 204*b* of the second PHC pile 200*b*, so that the first and second PHC piles 200*a* and 200*b* can be connected to each other.

After the insertion of the connection bar 220, the portion of the connection pipe into which the connection bar has been inserted is fixed by the fixing steel member 602 to prevent the connection bar 220 from coming out, as shown in FIG. 8 (step S706).

After the first and second PHC piles 200*a* and 200*b* have been connected to each other through steps S702, S704 and S706, other PHC piles can be additionally connected thereto by repeating steps S702, S704 and S706. Thus, a plurality of PHC piles can be connected to one another (step S708). After the PHC piles have been completely connected to one another as described above, concrete is poured into hollows 202*a* and 202*b* of the respective PHC pile to install a permanent retaining wall structure.

Although the technical spirit of the present invention has been described in connection with the preferred embodiment of the present invention, the embodiment is only for illustrative purposes. It can be understood by those skilled in the art that various embodiments can be made within the scope and spirit of the present invention.

INDUSTRIAL APPLICABILITY

As described above, the present invention has an advantage in that connection pipes serving as female connection bodies are embedded in a PHC pile for use in installing a permanent retaining wall structure, thereby minimizing damage to the connection pipes. Further, in the process of connecting the PHC piles to one another, separate connection bars serving as male connection bodies are inserted into the respective connection pipes of the PHC piles. Since the connection bar is not embedded in the PHC pile, there is an advantage in that the method of manufacturing the PHC pile can be simplified.

The invention claimed is:

1. A PHC pile used in a permanent retaining wall structure, comprising:

a left connection pipe in the form of a female connection body embedded at a side of the PHC pile; and a right connection pipe in the form of a female connection body embedded at an opposite side of the PHC pile, whereby a connection bar for use in connecting a plurality of PHC piles can be inserted into the left and right connection pipes, wherein each of the left and right connection pipes is in the form of a cylindrical pipe with a cut-away portion at a side thereof, and lateral sides of the cut-away portion are reinforced by a connection pipe-reinforcing material to reinforce the left and right connection pipes, and wherein the left and right connection pipes are closely connected to each other by means of an elongated binding steel member to prevent the connection pipes from coming out from the PHC pile.

2. The PHC pile as claimed in claim 1, wherein the left and right connection pipes are placed in a sheath of the PHC pile.

3. The PHC pile as claimed in any one of claims 1 and 2, wherein both lateral ends of the connection bar are configured to serve as male connection bodies for a right connection pipe of a first PHC pile and a left connection pipe of a second PHC pile so that the connection bar can be inserted into the right and left connection pipes.

4. A method of connecting PHC piles to each other, each of the PHC piles having an elongated binding steel member, and left and right connection pipes embedded therein for serving as female connection bodies upon installation of a permanent retaining wall structure, comprising: a first step of inserting a waterproof material into inner semi-cylindrical grooves of a right connection pipe of a first PHC pile and a left connection pipe of a second PHC pile; a second step of inserting a connection bar for connecting the PHC piles into the right connection pipe of the first PHC pile and the left connection pipe of the second PHC pile; and a third step of consecutively connecting a plurality of PHC piles to one another by repeating the first and second steps.

5. The method as claimed in claim 4, wherein the second step further comprises the step of attaching fixing steel members to the tops of the right connection pipe of the first PHC pile and the left connection pipe of the second PHC pile into which the connection bar has been inserted, thereby preventing the connection bar from coming out therefrom.

* * * * *